US007431574B2

(12) United States Patent
Onishi

(10) Patent No.: US 7,431,574 B2
(45) Date of Patent: Oct. 7, 2008

(54) PUMP ACTUATED BY DIAPHRAGM

(75) Inventor: Hitoshi Onishi, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 656 days.

(21) Appl. No.: 11/022,476

(22) Filed: Dec. 21, 2004

(65) Prior Publication Data

US 2005/0139002 A1 Jun. 30, 2005

(30) Foreign Application Priority Data

Dec. 26, 2003 (JP) ..... 2003-432687

(51) Int. Cl.
*F04B 17/00* (2006.01)

(52) U.S. Cl. ..... 417/413.2; 417/413.1

(58) Field of Classification Search ..... 417/413.1, 417/413.2, 53
See application file for complete search history.

(56) References Cited

U.S. PATENT DOCUMENTS

| | | | | |
|---|---|---|---|---|
| 3,606,592 | A * | 9/1971 | Madurski et al. | 417/413.1 |
| 4,936,758 | A * | 6/1990 | Coble | 417/413.1 |
| 4,939,405 | A * | 7/1990 | Okuyama et al. | 310/330 |
| 5,002,471 | A * | 3/1991 | Perlov | 417/413.1 |
| 7,198,250 | B2 * | 4/2007 | East | 251/129.06 |
| 7,219,848 | B2 * | 5/2007 | Sweeton | 239/102.2 |
| 7,287,965 | B2 * | 10/2007 | Vogeley et al. | 417/413.2 |
| 2006/0056999 | A1 * | 3/2006 | East | 417/413.2 |
| 2006/0239844 | A1 * | 10/2006 | Nakayama | 417/413.2 |
| 2007/0065309 | A1 * | 3/2007 | Nakajima et al. | 417/413.1 |

FOREIGN PATENT DOCUMENTS

| | | |
|---|---|---|
| EP | 1 277 957 | 1/2003 |
| JP | 59-221485 | 12/1984 |
| JP | 10-220357 | 8/1998 |
| JP | 2000-265964 | 9/2000 |
| JP | A-2000-265964 | 9/2000 |
| JP | 2003-120541 | 4/2003 |

OTHER PUBLICATIONS

Search Report dated Oct. 24, 2006 for corresponding European Patent Application No. 04027523.2.

* cited by examiner

*Primary Examiner*—William H Rodriguez
(74) *Attorney, Agent, or Firm*—Brinks Hofer Gilson & Lione

(57) ABSTRACT

A pump includes a diaphragm vibrated by a piezoelectric element and a case. An inlet orifice and an outlet orifice are disposed on an outer surface of the case. An inlet path connects the inlet orifice to an inlet and an outlet path connects the outlet orifice to an outlet. At least one portion of the inlet orifice and at least one portion of the outlet orifice are positioned higher than the diaphragm in the case, and portions of the inlet path and the outlet path connecting to the inlet orifice and the outlet orifice are positioned higher than the diaphragm.

31 Claims, 5 Drawing Sheets

PUMP ACTUATED BY DIAPHRAGM

This application claims the benefit of Japanese Patent Application 2003-432687, filed on Dec. 26, 2003, which is incorporated herein by reference.

TECHNICAL FIELD

The present application relates to a pump actuated by a diaphragm, which may be suitable for cooling compact, low-profile electronic devices such as notebook personal computers.

BACKGROUND

Various types of compact, lightweight pumps including diaphragms as oscillators have been proposed. In such lightweight pumps, the diaphragms are composed of metallic sheets and piezoelectric elements such as lead zirconate titanate (PZT) adhering to the metallic sheets. FIG. 6 is a cross-sectional view of a pump utilizing a diaphragm as an oscillator (see Japanese Unexamined Patent Application Publication No. 2000-265964, in particular, FIG. 1). A sheet piezoelectric element 101 such as PZT is disposed on the upper side of a hollow box-type casing 100 in a pump A so as to partition the interior of the casing 100. A space 102 is disposed above the piezoelectric element 101 and a pump chamber 103 is disposed below the piezoelectric element 101. Supplying power to the piezoelectric element 101 causes the piezoelectric element 101 to vibrate in its thickness direction, thereby changing the volume of the pump chamber 103.

An inlet orifice 105 is disposed on the right bottom side of the casing 100 and an outlet orifice 106 is disposed on the left bottom side of the casing 100. An inlet path 107 extends to the center area of the casing 100 so as to communicate with the inlet orifice 105, whereas an outlet path 108 extends to the center area of the casing 100 so as to communicate with the outlet orifice 106. A partition wall 110 is disposed in the center area of the casing 100 to separate the inlet path 107 from the outlet path 108. An inlet passage 111 connecting the pump chamber 103 to the inlet path 107 and an outlet passage 112 connecting the pump chamber 103 to the outlet path 108 are disposed in the vicinity of the partition wall 110. A check valve 113 is disposed at the inlet passage 111 and a check valve 115 is disposed at the outlet passage 112. When a driving circuit (not shown) applies a voltage to the piezoelectric element 101, the piezoelectric element 101 vibrates.

In the pump A for circulating a fluid, vibration of the piezoelectric element 101, acting as a diaphragm, changes the volume of the pump chamber 103 such that a fluid is sucked into the pump chamber 103 from the inlet orifice 105 through the check valve 113 and the fluid is discharged from the outlet orifice 106 through the check valve 115. Foam 117 for preventing pump pulsation is disposed in the recessed portions of the inlet path 107 and the outlet path 108 close to the bottom of the casing 100 shown in FIG. 6.

A fluid is circulated by way of pumping, using the minute reciprocating movement of the piezoelectric element 101, so that the size and weight of the pump A are considerably reduced as compared to regular fluid pumps utilizing screws or pistons. However, application of this type of pump in electronic devices such as notebook personal computers or mobile information devices is limited without further miniaturization of the devices.

If a reduction of the entire thickness of the pump A is attempted, the upper section of the casing 100 above the piezoelectric element 101 can be made thinner but the bottom section of the casing 100 cannot be made thinner. The foam 117, the inlet orifice 105, the outlet orifice 106, the inlet path 107, and the outlet path 108 are disposed above the recessed portions and thus miniaturization of the pump is limited due to the height of these components. In fact, the entire thickness of the pump includes the thicknesses of the piezoelectric element 101, the casing accommodating the piezoelectric element 101, the pump chamber 103, the check valve 113 or the check valve 115, and the inlet orifice 105 or the outlet orifice 106, and thus it is difficult to further reduce the entire thickness of the pump. Since mobile information devices such as notebook personal computers are being further miniaturized, the thickness of a pump used in a cooling device for such mobile information devices needs to be further reduced. However, the known pump shown in FIG. 6 is not small enough for application in such devices.

SUMMARY

A compact, low-profile pump that can be used, for example, in a cooling device for electronic devices such as notebook computers which are being further miniaturized is described.

The pump includes a diaphragm having a composite piezoelectric element, the diaphragm being vibrated by the piezoelectric element and a case accommodating the diaphragm, the peripheral portion of the diaphragm being restrained by the case. The case includes a pump chamber communicating with one side of the diaphragm, an inlet and an outlet both communicating with the pump chamber, the inlet including an inlet check valve and the outlet including an outlet check valve; an inlet orifice and an outlet orifice disposed on an outer surface of the case, and an inlet path and an outlet path, the inlet path connecting the inlet orifice to the inlet, the outlet path connecting the outlet orifice to the outlet, the inlet check valve charging a fluid into the pump chamber from the inlet path, the outlet check valve discharging the fluid from the pump chamber to the outlet path. In this pump, at least one portion of the inlet orifice and at least one portion of the outlet orifice are positioned higher than the diaphragm with respect to the bottom of the case, and the inlet orifice and the outlet orifice are positioned higher than the inlet path and the outlet path.

The case may include a bottom case and a top case, the bottom case including a connecting portion on an outer surface of the bottom case, the connecting portion having a thickness greater than that of the bottom case and less than or equal to that of the case, the inlet orifice and the outlet orifice being disposed on an outer surface of the connecting portion.

The inlet path and the outlet path may extend below the diaphragm in the bottom case towards the connecting portion disposed on the outer surface of the bottom case, and the inlet path is connected to the inlet orifice in the connecting portion and the outlet path is connected to the outlet orifice in the connecting portion.

The center lines of the inlet orifice and the outlet orifice disposed in the connecting portion are higher than those of the inlet path and the outlet path disposed in the bottom case, an inlet communication passage communicating with the inlet orifice extends along the thickness of the connecting portion in the inlet path, and an outlet communicating passage communicating with the outlet orifice extends along the thickness of the connecting portion in the outlet path.

The bottom case may have a thin plate shape, the inlet path and the outlet path in the bottom case each may have a flat cross-section, and at least one of the inlet path and the outlet path proximal to the connecting portion has a recessed section, the recessed section increasing the cross-section of the inlet path or the outlet path.

The bottom case may have an opening at the bottom surface, the opening having an area corresponding to the inlet path and the outlet path, the inlet check valve and the outlet check valve, and the inlet communicating passage and the outlet communicating passage in the connecting portion, the opening being closed with a cover.

The thickness of the connecting portion in the thickness direction of the bottom case may be larger than the length of the connecting portion in the direction orthogonal to the thickness of the connecting portion.

The case includes a bottom case and a top case, and the diaphragm is disposed between the bottom case and the top case such that the diaphragm vibrates inside the case.

At least one portion of the inlet orifice and at least one portion of the outlet orifice are positioned higher than the diaphragm in the case, and the inlet orifice and the outlet orifice may be positioned higher than the inlet path and the outlet path, so that components that may impede the low-profile construction can be positioned high in the case. Therefore, the entire case including the inlet orifice, the outlet orifice, the inlet path, and the outlet path can have a low profile.

The case may be comprised of the bottom case and the top case. The connecting portion is disposed on the outer surface of the bottom case, the connecting portion having a thickness greater than that of the bottom case and less than or equal to that of the entire case. The inlet orifice and the outlet orifice are disposed on the connecting portion. Accordingly, the thickness of the entire case does not become larger than necessary, while the thicknesses of the inlet orifice and the outlet orifice can be made as large as possible. Therefore, the thicknesses of the both orifices do not prevent the low-profile construction and miniaturization. Accordingly, the pump has a low-profile construction, while the sufficient thicknesses of the orifices and a sufficient flow rate necessary for pumping can be achieved.

Since the inlet path and the outlet path extend below the diaphragm to the connecting portion, and the inlet path is connected to the inlet orifice and the outlet path is connected to the outlet orifice in the connecting portion, the length of the inlet path to the inlet orifice in the connecting portion and the length of the outlet path to the outlet orifice in the connecting portion may be made smaller.

The center lines of the inlet orifice and the outlet orifice may be higher than those of the inlet path and the outlet path. An inlet communication passage communicating with the inlet orifice extends along the thickness of the connecting portion in the inlet path, and an outlet communicating passage communicating with the outlet orifice extends along the thickness of the connecting portion in the outlet path. Accordingly, the orifices can be positioned higher than the inlet path and the outlet path and thus the components that prevent the low-profile construction can be situated higher in the case. Thus, the entire case including the inlet and outlet orifices and the inlet and outlet paths can have a low profile.

Since the bottom case has a thin plate shape, and the inlet path and the outlet path may each have a flat cross-section, and the pump can have a low-profile construction. Further, a recessed section is disposed in at least one of the inlet path and the outlet path close to the connecting portion, the recessed section increasing the cross-section of the inlet path or the outlet path. Therefore, even though the inlet and outlet paths have a low-profile construction, a sufficient flow rate necessary for pumping can be obtained through the large cross-section of the flow path.

Furthermore, an opening may be disposed at the bottom surface of the bottom case, the opening communicating with the inlet path and the outlet path, the inlet check valve and the outlet check valve, and the inlet communicating passage and outlet communicating passage in the connecting portion, the opening being closed with a cover. In the case where the bottom case is formed of a resin with a die, since the opening is provided on the bottom of the case body, the path of the resin flowing in the cavity of the die is more effective. This may facilitate the formation of the case body with the resin and die.

The thickness of the connecting portion in the direction along the thickness of the bottom case is larger than the length of the connecting portion in the direction orthogonal to the thickness of the connecting portion. Therefore, the size of the connecting portion protruding from the bottom case may be made as small as possible, while the cross-sections of the orifices are made as large as possible.

The case is composed of a bottom case and a top case, the diaphragm is disposed between the bottom case and the top case such that the diaphragm vibrates inside the case.

Thus, the pump can be used in a cooling device for notebook personal computers or portable electronic devices which have a low-profile construction.

DETAILED DESCRIPTION

Figure 1:
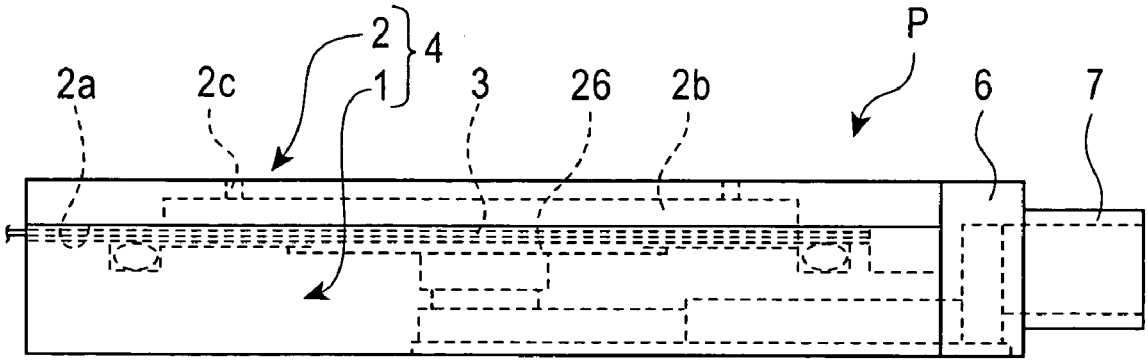
FIG. 1 is a side view of a pump.

Features of the present invention will appear in the following description of an embodiment given by way of a non-limiting example, with reference to the figures, in which like numbered elements in the same or different drawings perform equivalent functions FIGS. 1 to 5 show a pump P, which includes a bottom case 1, a top case 2, and a diaphragm 3. The bottom case 1 has a flat thin plate shape. The top case 2 is disposed on the bottom case 1. The diaphragm 3 has a thin disk shape and is disposed between the bottom case 1 and the top case 2. The bottom case 1 and the top case 2 comprise a case 4. The bottom case 1 may be molded of, for example, resin and includes a plate-shaped case body 5, a connecting portion or connecting block 6, an inlet orifice 7, and an outlet orifice 8. The connecting block 6 protrudes from one outer surface of the case body 5. The inlet orifice 7 and the outlet orifice 8 may be cylindrical and protrude outward from the connecting block 6. The case body 5, the connecting block 6, the inlet orifice 7, and the outlet orifice 8 may be formed as an integrated assembly.

Figure 4:
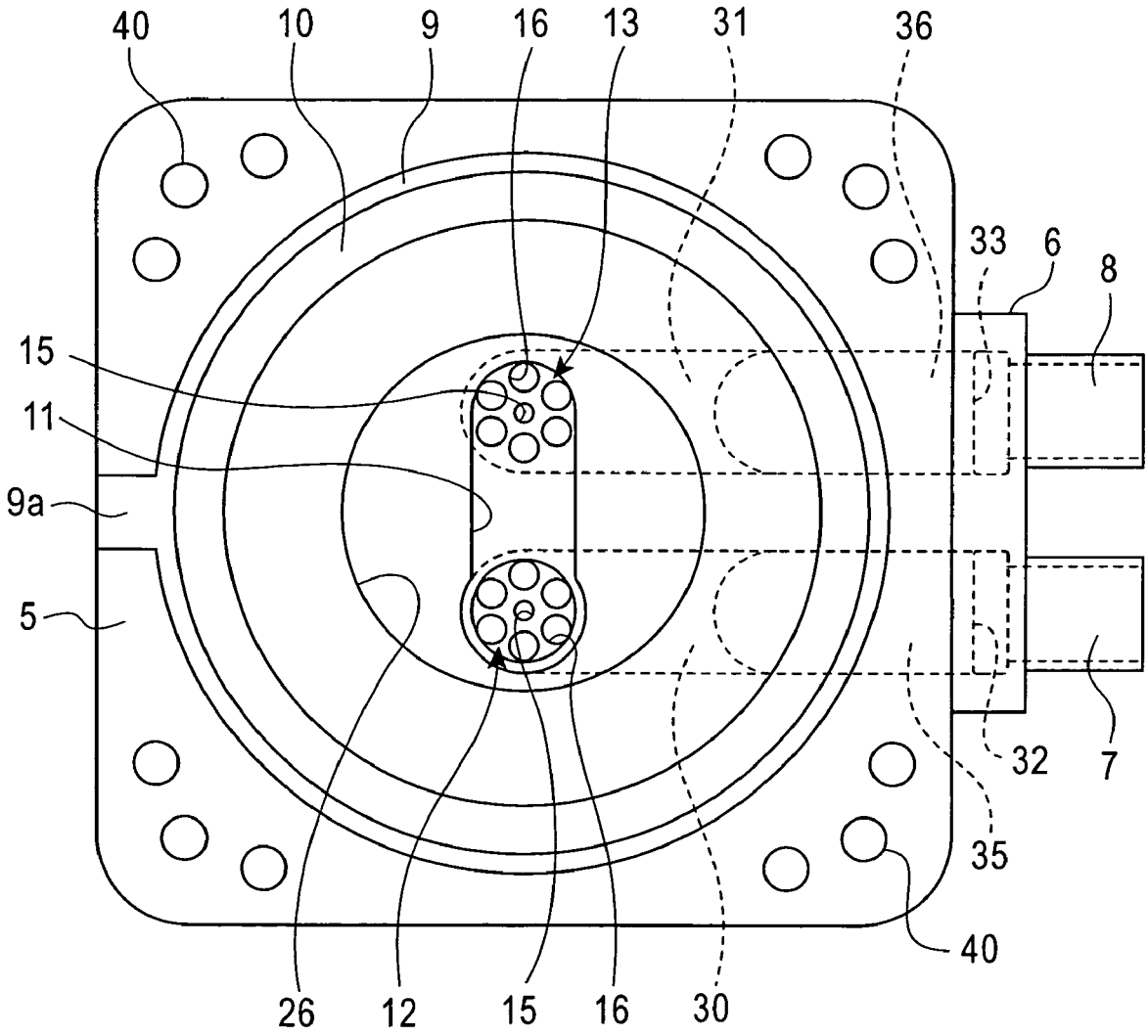
FIG. 4 is a plan view of the bottom case of the pump.
Figure 5:
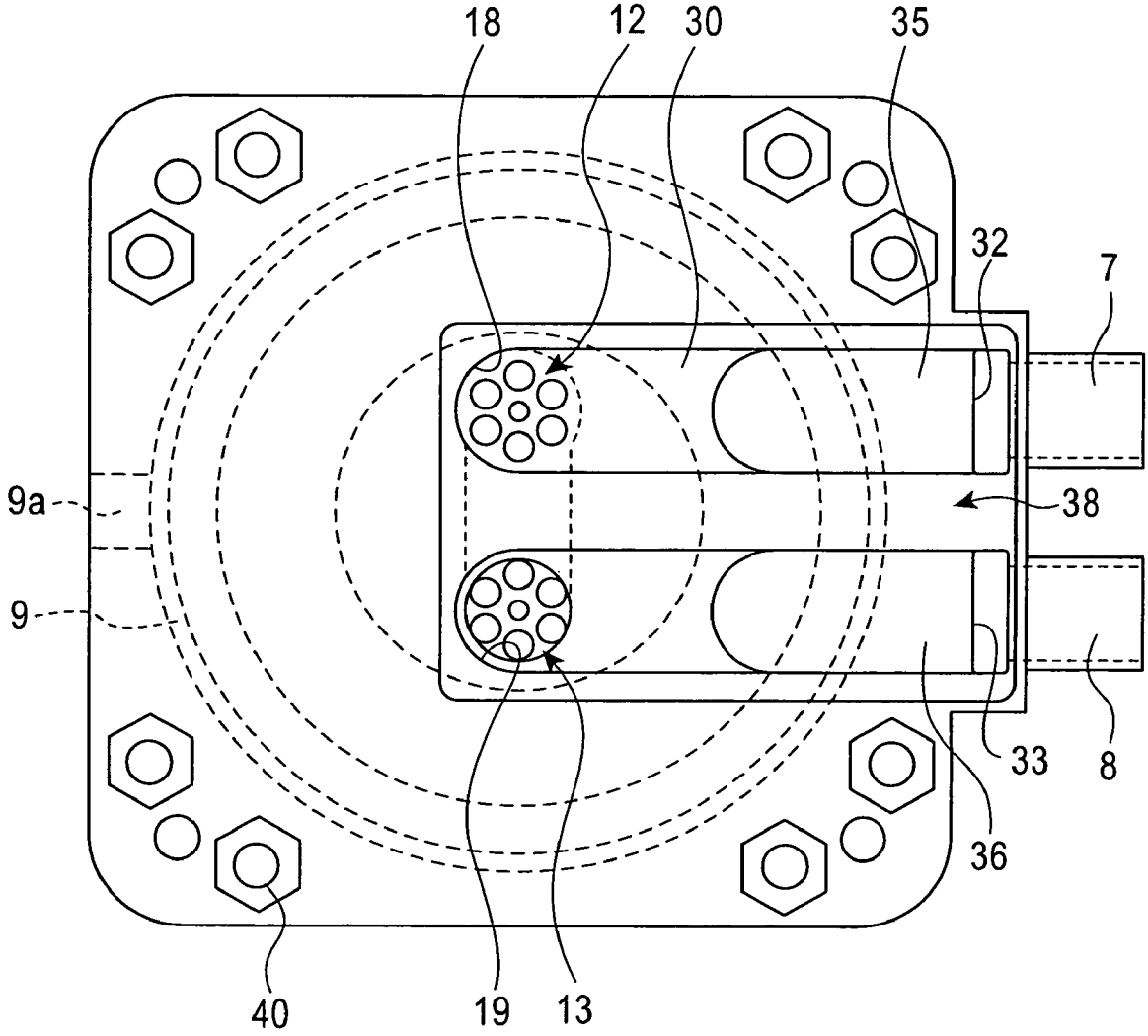
FIG. 5 is a bottom view of the bottom case of the pump.
Figure 6:
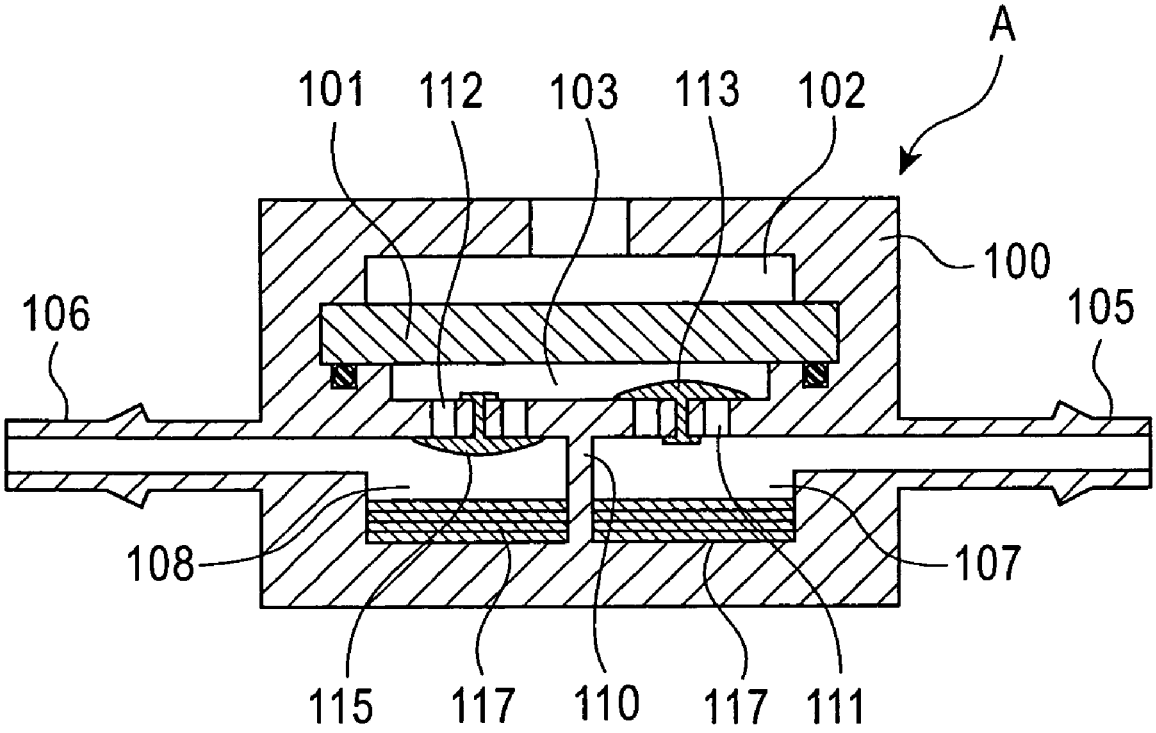
FIG. 6 PRIOR ART
FIG. 6 is a cross-sectional view of a known pump.

A circumferential projection 9 is disposed on the upper surface of the case body 5 and holds the diaphragm 3 when the circular diaphragm 3 is sandwiched between the bottom case 1 and the top case 2, as described in detail below. A projecting portion 9a is disposed on the outer surface of the circumferential projection 9 opposite from the connecting block 6. A circumferential groove 10 is disposed on the inner surface of the circumferential projection 9. A recessed portion 11 is disposed inside the circumferential groove 10 and has an approximately oblong shape when viewed from the top, as shown in FIG. 4. The recessed portion 11 includes an inlet 12 and an outlet 13 on the respective ends. The inlet 12 and the outlet 13 pass through the case body 5. The inlet 12 and the outlet 13 each have a single center hole 15 and six through-holes 16 spaced radially from the center hole 15, as shown in FIGS. 4 and 5. A concave portion 18 is disposed on the bottom of the case body 5 toward the inlet 12, and a concave portion 19 is disposed on the bottom of the case body 5 toward the outlet 13. The concave portions 18 and 19 each have a disk shape when viewed from the top.

A mushroom-shaped check valve or inlet valve 20 made of, for example, flexible resin is disposed in the center hole 15 of the inlet 12, whereas a mushroom-shaped check valve or outlet valve 21 made of, for example flexible resin is disposed in the center hole 15 of the outlet 13. The inlet valve 20 has a head 20*a* for covering the six through-holes 16. The inlet valve 20 permits flow from the concave portion 18 on the bottom of the case body S to the recessed portion 11 close to the upper surface of the case body 5 and prevents the reverse flow. The outlet valve 21 has a head 21*a* for covering the six through-holes 16. The outlet valve 21 permits flow from the recessed portion 11 close to the upper surface of the case body 5 to the concave portion 19 on the bottom of the case body 5 and prevents the reverse flow.

The diaphragm 3 is disposed on the upper surface of the case body 5 and includes a circular shim 22 made of, for example, stainless steel sheet, and piezoelectric sheets or piezoelectric elements 23 and 24 of PZT adhering to both surfaces of the shim 22. A protrusion 22*a* protrudes outward from the circumference of the shim 22 in the diaphragm 3. The flat top case 2 is disposed on the diaphragm 3 so as to cover the top surface of the case body 5. A receiving surface 2*a* is disposed on the bottom surface of the top case 2 and catches the peripheral portion of the diaphragm 3 with the circumferential projection 9. A circular recess 2*b* is disposed in the center area of the bottom of the top case 2 and has a diameter that is slightly smaller than that of the diaphragm 3. An air hole 2C is disposed in the top case 2 and passes through the top case 2 to reach the recess 2*b*.

The diaphragm 3 is disposed between the top case 2 and the case body 5. More specifically, the diaphragm 3 is placed between the receiving surface 2*a* of the top case 2 and the circumferential projection 9 of the case body 5. A seal 25 such as an o-ring is disposed in the circumferential groove 10. This seal 25 is pushed into the inside of the circumferential groove 10 by the peripheral portion of the diaphragm 3 to provide a fluid-tight structure. Since the diaphragm 3 is disposed between the top case 2 and the case body 5, a pump chamber 26 is formed between the diaphragm 3 and the recessed portion 11 of the case body 5.

An inlet path 30 having a flat cross-section linearly extends in parallel to the diaphragm 3 towards the connecting block 6 so as to communicate with the concave portion 18 in the inlet 12 near the bottom of the case body 5. An outlet path 31 having a flat cross-section linearly extends in parallel to the diaphragm 3 towards the connecting block 6 so as to communicate with the concave portion 19 in the outlet 13. The inlet path 30 and the outlet path 31 are connected to the connecting block 6. The connecting block 6 may have a thickness substantially identical to the sum of the thicknesses of the top case 2 and the case body 5. The width of the connecting block 6 along the side surface of the case body 5 is about half of the width of the case body 5. The length of the connecting block 6 protruding from the case body 5 is slightly smaller than the thickness of the connecting block 6. The inlet path 30 and the outlet path 31 are both connected to the connecting block 6. An inlet communicating passage 32 and an outlet communicating passage 33 are disposed inside the connecting block 6 and extend in the thickness direction of the connecting block 6. Therefore, the inlet communicating passage 32 connects the inlet path 30 to the inlet orifice 7, whereas the outlet communicating passage 33 connects the outlet path 31 to the outlet orifice 8. The bottom surfaces of the inlet communicating passage 32 and the outlet communicating passage 33 reach the bottom surface of the connecting block 6 to communicate with an opening 38, as described below. The center line of the inlet orifice 7 is higher than that of the inlet path 30, and the center line of the outlet orifice 8 is higher than that of the outlet path 31. The top surfaces of the inlet orifice 7 and the outlet orifice 8 are both higher than the diaphragm 3.

Due to the aforementioned structure, a flow path from the inlet orifice 7 to the outlet orifice 8 via the inlet communicating passage 32, the inlet path 30, the concave portion 18, the inlet 12, the through-holes 16, the recessed portion 11, the through-holes 16, the concave portion 19, the outlet path 31, and the outlet communicating passage 33 is established. A recessed section 35 is disposed proximal to the connecting block 6 in the inlet path 30 near the bottom of the case body 5. Provision of the recessed section 35 makes the cross-section of the inlet path 30 larger close to the connecting block 6. A recessed section 36 is disposed close to the connecting block 6 in the outlet path 31. Provision of the recessed section 36 makes the cross-section of the outlet path 31 larger close to the connecting block 6. Moreover, the opening 38 may be disposed on the bottom of the case body 5 so as to communicate with the inlet communicating passage 32, the recessed section 35, the inlet path 30, the concave portion 18, the concave portion 19, the outlet path 31, the recessed section 36, and the outlet communicating passage 33. A cover 39 is glued to the periphery of the opening 38 to cover the opening 38.

As shown in FIGS. 4 and 5, holes 40 are disposed in the corners of the case body 5 and the top case 2. Bolts are inserted into the holes 40 and tightened with nuts, and thus the case body 5 and top case 2 with the diaphragm 3 interposed therebetween are tightly integrated. Alternatively an adhesive material or other method of joining such as rivets may be used.

Figure 2:
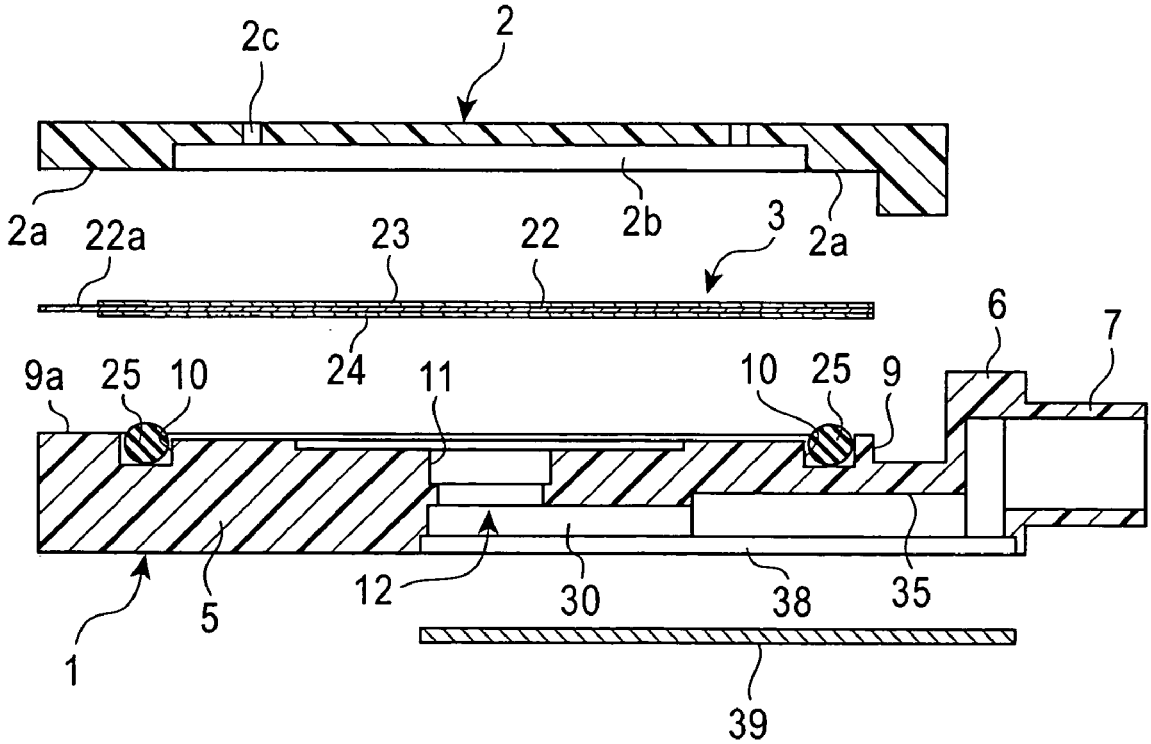
FIG. 2 is an exploded view of the compact.
Figure 3:
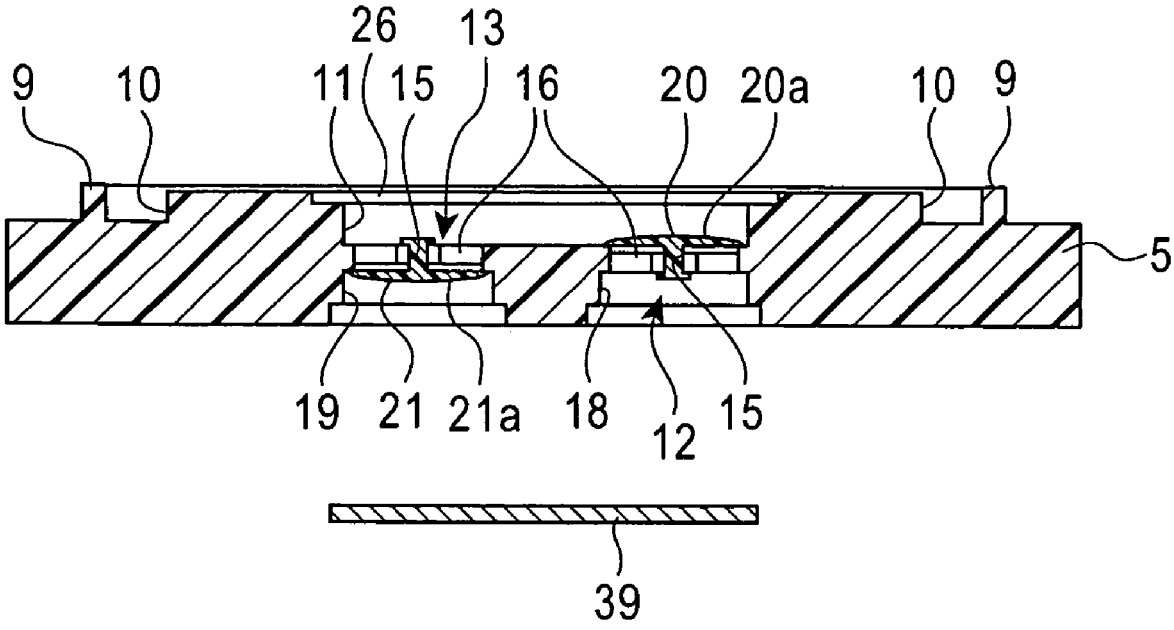
FIG. 3 is a cross-sectional view of a bottom case of the pump.

Referring to FIG. 2, wiring (not shown) is provided with the piezoelectric elements 23 and 24 in the diaphragm 3. Ends of the wiring in the piezoelectric elements 23 and 24 are soldered to the circumferences of the piezoelectric elements 23 and 24 and pass by the protrusion 22*a* of the shim 22 to be led outside and connected to a driving circuit (not shown). By supplying electrical power to the piezoelectric elements 23 and 24, the diaphragm 3 including the shim 22 vibrates.

The operation and effects of the pump P having the aforementioned structure will now be described. When the driving circuit (not shown) applies a voltage to the piezoelectric elements 23 and 24, the piezoelectric elements 23 and 24 vibrate in the pump P. The outlet orifice 8 discharges a fluid such as water in the pump chamber 26 through the outlet valve 21, the concave portion 19, the outlet path 31, the recessed section 36, and the outlet communicating passage 33, whereas the inlet orifice 7 charges the fluid into the pump chamber 26 through the inlet communicating passage 32, the recessed section 35, the inlet path 30, the concave portion 18, and the inlet valve 20. In this way, the pump P causes a fluid to continuously flow by pressure.

The center lines of the inlet orifice 7 and the outlet orifice 8 are higher than the center lines of the inlet path 30 and the outlet path 31 in the direction along the thickness of the bottom case 1 in the pump P. The upper surfaces of the portions of the inlet path 30 and the outlet path 31 that are connected to the inlet orifice 7 and the outlet orifice 8, that is, the upper surfaces of the inlet communicating passage 32 and the outlet communicating passage 33 and the upper surfaces of the inlet orifice 7 and the outlet orifice 8 are higher than the diaphragm 3. Accordingly, the inlet orifice 7, the outlet orifice 8, the inlet communicating passage 32, and the outlet communicating passage 33, which hamper a low-profile construction, are disposed at a high position in the case body 5. Thus, the case body 5 including the inlet orifice 7, the outlet orifice 8, the inlet path 30, and the outlet path 31 can have a low profile.

Furthermore, the case 4 is composed of the bottom case 1 and the top case 2 and the connecting block 6 is disposed on the outer surface of the case body 5 in the bottom case 1, the connecting block 6 having a thickness larger than that of the bottom case 1 and smaller than that of the case body 5. The inlet orifice 7 and the outlet orifice 8 are disposed in the connecting block 6. Accordingly, the thicknesses of the inlet orifice 7 and the outlet orifice 8 can be maximized while an increase in the entire thickness of the case 4 is minimized. Thus, the low-profile construction and miniaturization of the pump P can be readily achieved. Consequently, while a sufficient flow rate for pumping is achieved by making the thicknesses of the inlet orifice 7 and the outlet orifice 8 sufficiently large, the pump P can realize a low-profile construction.

The inlet path 30 and the outlet path 31 extend below the diaphragm 3 to the connecting block 6 and connect to the inlet orifice 7 and the outlet orifice 8. The flow path resistance in the pump P may be reduced by minimizing the length of the inlet path 30 to the inlet orifice 7 and the length of the outlet path 31 to the outlet orifice 8 in the connecting block 6.

Furthermore, the center lines of the inlet orifice 7 and the outlet orifice 8 are higher than those of the inlet path 30 and the outlet path 31. That is, the inlet communicating passage 32, which connects the inlet path 30 to the inlet orifice 7, is disposed in the inlet path 30, and the outlet communicating passage 33, which connects the outlet path 31 to the outlet orifice 8, is disposed in the outlet path 31. The inlet communicating path 32 and the outlet communicating passage 33 extend in the thickness direction of the connecting block 6. Therefore, the inlet orifice 7 and the outlet orifice 8 may be positioned higher than the inlet path 30 and the outlet path 31. Accordingly, the components that hamper the low-profile construction are disposed at a high position in the case body 5, whereby the entire case including the inlet orifice 7, the outlet orifice 8, the inlet path 30, and the outlet path 31 can have a low-profile construction.

Furthermore, since the case body 5 of the bottom case 1 has a thin plate shape and the inlet path 30 and the outlet path 31 each have a flat cross-section, the pump P can have a low profile. The inlet path 30 and the outlet path 31 are connected to the inlet orifice 7 and the outlet orifice 8 through the inlet communicating passage 32 and the outlet communicating passage 33 in the connecting block 6. Accordingly, the inlet path 30 and the outlet path 31 are flat in the cross-section in the case body 5, thereby making the height (thickness) of the case body 5 as small as possible. On the other hand, since the widths of the inlet path 30 and the outlet path 31 may be larger than those of the inlet orifice 7 and the outlet orifice 8, the flow path has a large cross-section. Furthermore, even though the cylindrical inlet orifice 7 and outlet orifice 8 having large cross-sections are disposed at high positions in the case body 5, the thickness of the entire case 4 including the top case 2 does not become larger than necessary.

The inlet path 30 and the outlet path 31 are provided with the recessed section 35 and the recessed section 36 at the ends thereof connected to the connecting block 6. Therefore, even though the inlet path 30 and the outlet path 31 have flat cross-sections and thus the case body 5 has a low profile, the flow path has a large cross-section that allows a sufficient flow rate necessary for the pump P. Since the recessed section 35 is provided at the inlet path 30, the flat inlet path 30 is connected to the inlet orifice 7, which is positioned higher than the inlet path 30, with a large connection area through the inlet communicating passage 32. Since the recessed section 36 is provided at the outlet path 31, the flat outlet path 31 is connected to the inlet orifice 8, which is positioned higher than the outlet path 31, with a large connection area through the outlet communicating passage 33. In this way, the resistance of the flow path is minimized.

In the pump P, the opening 38, which communicates with the inlet path 30 and the outlet path 31, the inlet valve 20 and the outlet valve 21, and the inlet communicating passage 32 and the outlet communicating passage 33 in the connecting block 6, is provided on the bottom of the case body 5 in the bottom case 1, and the opening 38 is closed by the cover 39. Therefore, in the case where the bottom case 1 is formed of a resin with a die composed of an upper section and a lower section, since the opening 38 is provided on the bottom of the case body 5, the path of the resin flowing in the cavity defined by the upper section and the lower section of the die is easily achieved. This facilitates the formation of the case body 5 with the resin and die. In another aspect, in the case where the die is composed of separable upper and lower sections, since the opening 38 is provided at the case body 5 separated from the cover 39, the upper section can be easily detached from the lower section, facilitating designing of the die.

Since the thickness of the connecting block 6 in the thickness direction of the bottom case 1 is larger than the length of the connecting block 6 orthogonal to the thickness of the connecting block 6, the connecting block 6 connected to the case body 5 in the bottom case 1 is made as small as possible, while the cross-sections of the inlet orifice 7 and the outlet orifice 8 are made as large as possible. In this way, the connecting block 6 protruding from the case body 5 is miniaturized, leading to overall miniaturization of the pump P.

As has been described above, since the pump P of the present invention has a structure that enables miniaturization of the pump, the pump P can be used in a cooling device for notebook personal computers or portable electronic devices which have a and low-profile construction.

Although specific materials have been mentioned in the description, they are exemplary, as other engineering materials such as metals, composites and other moldable substances may be used, depending on structural, environmental and manufacturing considerations.

While the present invention has been explained by way of the embodiments described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A pump, comprising:

a diaphragm having a plane surface; and a case accommodating the diaphragm, the case comprising:

a top case portion disposed on a bottom case portion;

a pump chamber communicating with a side of the diaphragm that faces the bottom case portion;

an inlet orifice and an outlet orifice, the inlet orifice and the outlet orifice communicating with the pump chamber; and an inlet check valve and an outlet check valve disposed between the respective inlet and outlet orifices and the pump chamber, wherein at least one portion of the inlet orifice and at least one portion of the outlet orifice are positioned higher than the plane surface of the diaphragm with respect to the bottom case portion.

2. The pump according to claim 1, wherein the diaphragm is comprised of a flexible member, at least part of a face of the flexible member having a piezoelectric material affixed thereto.

3. The pump according to claim 1, wherein an inlet portion and an outlet portion is disposed between the inlet orifice and the inlet check valve outlet orifice and the outlet check valve, respectively.

4. The pump according to claim 3, wherein an inlet path is disposed between the inlet orifice and the inlet portion, and an outlet path is disposed between the outlet orifice and the outlet portion.

5. The pump according to claim 4, wherein the bottom case portion includes a connecting portion on an outer surface of the bottom case portion, the connecting portion having a thickness greater than that of the bottom case portion and less than or equal to that of the case, the inlet orifice and the outlet orifice being disposed on an outer surface of the connecting portion.

6. The pump according to claim 5, wherein the inlet path and the outlet path extend below the diaphragm in the bottom case towards the connecting portion, and the inlet path is connected to the inlet orifice and the outlet path is connected to the outlet orifice.

7. The pump according to claim 6, wherein center lines of the inlet orifice and the outlet orifice are disposed higher than center lines of the inlet path and the outlet path, an inlet communication passage communicating with the inlet orifice extends along the thickness of the connecting portion in the inlet path, and an outlet communicating passage communicating with the outlet orifice extends along the thickness of the connecting portion in the outlet path.

8. The pump according to claim 6, wherein the thickness of the connecting portion is greater than the length of the connecting portion in a direction orthogonal to the thickness of the connecting portion.

9. The pump according to claim 5, wherein the bottom case portion has a thin plate shape, the inlet path and the outlet path in the bottom case portion each have a flat cross-section, and at least one of the inlet path and the outlet path proximal to the connecting portion has a recessed section, the recessed section increasing a cross-section of the inlet path or the outlet path.

10. The pump according to claim 5, wherein the bottom case portion has an opening at a bottom surface, the opening having an area corresponding to the inlet path and the outlet path, the inlet check valve and the outlet check valve, and an inlet communicating passage and an outlet communicating passage in the connecting portion, the opening being closed with a cover.

11. The pump according to claim 1, wherein the bottom case portion includes a connecting portion on an outer surface of the bottom case portion, the connecting portion having a thickness greater than that of the bottom case portion and less than or equal to that of the case, the inlet orifice and the outlet orifice being disposed on an outer surface of the connecting portion.

12. The pump according to claim 1, wherein the diaphragm is disposed between the bottom case portion and the top case portion such that the diaphragm vibrates.

13. The pump according to claim 1, wherein the bottom case portion includes a first recess for accommodating an O-ring, the first recess having a diameter less than a diameter of the diaphragm, the top case portion and the bottom case portion fastened together such that the diaphragm is retained therebetween and the O-ring forms a fluid-retaining seal.

14. The pump according to claim 13, wherein the first recess is an annular recess.

15. The pump according to claim 13, wherein the bottom case portion has a second recess disposed within the first recess and communicating with the input and output orifices, the second recess facing at least part of the diaphragm, and the diaphragm and the second recess forming the pump chamber.

16. The pump according to claim 13, wherein the top case portion has a third recess, disposed facing the bottom case portion, and opposing the diaphragm, the top case portion having at least one aperture between the third recess and an outer surface of the top case portion.

17. The pump according to claim 13, wherein the diaphragm is connected to a power source by wire leads such that the diaphragm is vibrated by applying an electric potential thereto.

18. The pump according to claim 15, wherein the second recess has an oblong shape.

19. The pump according to claim 1, wherein the bottom case portion includes a recess forming a part of the pump chamber, and each of the inlet check valve and the outlet check valve comprise at least one aperture in the bottom case portion, the aperture communicating between the pump chamber and each of the input orifice and the output orifice, respectively, each check valve further comprising an aperture accommodating and captivating a stem of a mushroom-shaped movable valve seal.

20. The pump according to claim 19, wherein a cap of the mushroom-shaped movable valve seal of the inlet check valve is disposed facing the diaphragm, and a stem of the mushroom-shaped movable valve seal of the outlet check valve is disposed facing the diaphragm.

21. The pump according to claim 15, wherein the mushroom-shaped valve seal is formed of a flexible resin.

22. The pump according to claim 3, wherein at least one of the input portion and the output portion has a disk-shaped cross section.

23. The pump according to claim 7, wherein the input check valve and the output check valve communicate with the input portion and the output portion, respectively through concave portions.

24. A method of pumping a fluid, the method comprising:

providing a case, the case having a top case portion and a bottom case portion, the bottom case portion having a recess and the top case portion having a recess, the recesses opposing each other;

providing a diaphragm, the diaphragm accommodated in the case such that the diaphragm is positioned opposite the recesses in the top case portion and the bottom case portion;

providing an O-ring, having a diameter greater than a maximum dimension of the recesses, the diameter being less than a diameter of the diaphragm, the O-ring being disposed in an annular recess in the bottom case portion, the annular recess being concentric with the recess in the bottom case portion; and providing an input orifice and an output orifice, at least a part of the input orifice and a part of the output orifice being located higher than a planar surface of the diaphragm with respect to the bottom case portion; the input and output orifices communicating with the recess in the bottom case portion through, respectively, an input check valve and an output check valve that are disposed between the diaphragm and the bottom case portion; and vibrating the diaphragm.

25. The method according to claim 24, wherein the diaphragm a flexible member having a piezoelectric material affixed to at least one surface.

26. A pump, comprising:

means for forming a pump chamber, one portion of the pump chamber containing a means for vibrating;

means for communicating a fluid from an input orifice to the pump chamber; and means for communicating a fluid from the pump chamber to an output orifice, wherein at least a first portion of the input orifice and a first portion of the output orifice lie on an opposite side of a plane coincident with a surface of the vibrating means from a second portion of the input orifice and a second portion of the output orifice, respectively.

27. The pump according to claim 26, wherein the means for vibrating is a diaphragm.

28. The pump according to claim 27, wherein the diaphragm comprises a flexible circular member, a piezoelectric material being affixed to at least one surface thereof.

29. The pump according to claim 28, wherein an electric potential is applied to the vibrating means by a means for connecting and a power supply.

30. A method of manufacturing a pump, the method comprising:

forming a top portion of a case, the top portion having a first recess therein;

forming a bottom portion of a case, the bottom portion having a second recess therein, and further comprising an annular recess of a diameter greater than, and coaxial with, the second recess;

forming a diaphragm, comprised of a flexible member having a piezoelectric material affixed to at least one surface thereof;

forming an input check valve and an output check valve in the second recess of the bottom portion, the input check valve and the output check valve communicating with, respectively, an input orifice and an output orifice in the bottom portion;

disposing an O-ring in the annular recess;

disposing the diaphragm on the O-ring, wherein the diaphragm is interposed between the first and second recesses; and retaining the diaphragm by placing the top portion on top of the diaphragm and joining the top portion and the bottom portion, wherein a first portion of the input orifice and a first portion of the output orifice are disposed such that they are higher than a plane passed through a surface of the diaphragm opposing the top portion with respect to the bottom portion.

31. The method of claim 30, further comprising molding a resin to form each of the top portion and the bottom portion.

* * * * *

UNITED STATES PATENT AND TRADEMARK OFFICE

CERTIFICATE OF CORRECTION

PATENT NO. : 7,431,574 B2
APPLICATION NO. : 11/022476
DATED : October 7, 2008
INVENTOR(S) : Hitoshi Onishi It is certified that error appears in the above-identified patent and that said Letters Patent is hereby corrected as shown below:

In column 11, claim 25, line 14, before "a flexible member" insert --comprises--.

Signed and Sealed this

Twenty-first Day of April, 2009

JOHN DOLL
*Acting Director of the United States Patent and Trademark Office*